United States Patent [19]

Henderson et al.

[11] 4,092,695

[45] May 30, 1978

[54] ELECTRICAL SHOCKING DEVICE

[75] Inventors: Gary A. Henderson, Arvada; Guy H. Williams, Parker, both of Colo.

[73] Assignee: American Home Products Corporation, New York, N.Y.

[21] Appl. No.: 752,575

[22] Filed: Dec. 20, 1976

[51] Int. Cl.[2] ..... F41B 15/04

[52] U.S. Cl. ..... 361/232; 231/2 E

[58] Field of Search ..... 361/232, 253, 254, 257, 361/262, 263; 273/84 ES; 231/2 E; 363/22, 23, 24, 59, 60, 61; 272/27 N

[56] References Cited

U.S. PATENT DOCUMENTS

| | | | |
|---|---|---|---|
| 2,799,809 | 7/1957 | Lautenberger | 363/59 X |
| 2,843,815 | 7/1958 | Driver | 363/22 |
| 3,008,068 | 11/1961 | Wilting et al. | 363/59 X |
| 3,819,108 | 6/1974 | Jordan | 273/84 ES |

*Primary Examiner*—Harry E. Moose, Jr.
*Attorney, Agent, or Firm*—Joseph Martin Weigman

[57] ABSTRACT

A battery powered, hand held, light weight electrical shocking device provides a visible and audible display of sparks continuously upon the operation of a switch. The device is capable of delivering a jolting shock. The display of sparks makes clear the nature of the device and serves as a deterrent to unruly persons. The circuit comprises a free-running multi-vibrator, a small transformer, a rectifier, a voltage doubler and an internal spark gap. The circuit can deliver a series of short duration, high voltage low current electrical shocks from two penlight batteries.

3 Claims, 4 Drawing Figures

FIG. 1
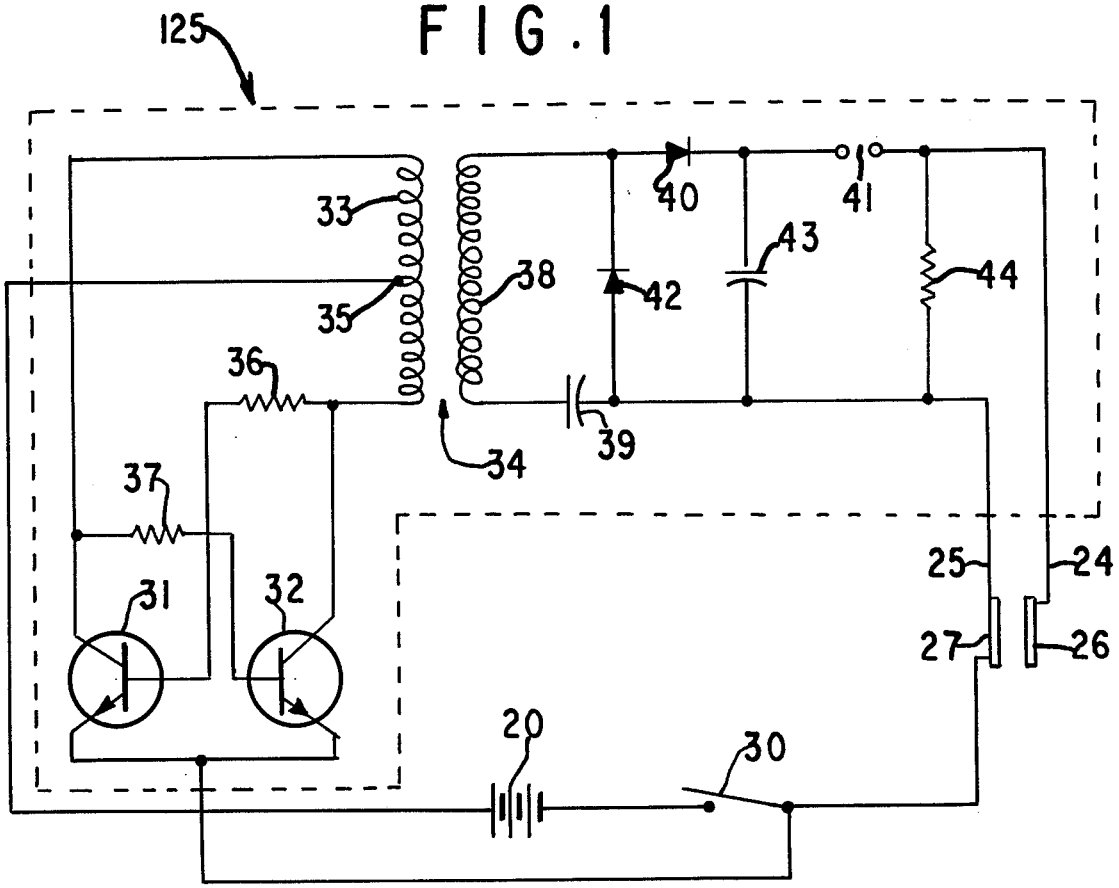
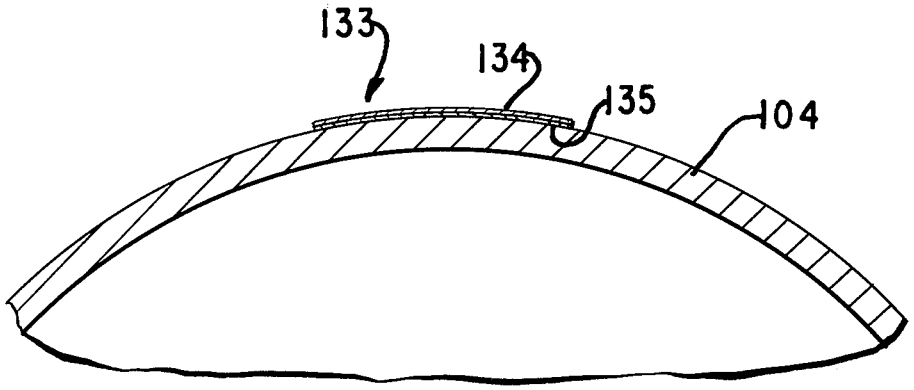
FIG. 4

ELECTRICAL SHOCKING DEVICE

This application is an improvement on the invention described in application Ser. No. 727,930 filed Sept. 29, 1976 by Gary A. Henderson which was in turn a division of application Ser. No. 548,590 filed Feb. 10, 1975 by Gary A. Henderson and Douglas K. DuBuque for Electrical Shocking Device. The entire disclosure of that application is included herein by reference.

The invention relates generally to shocking devices for riot control. More particularly, it relates to shocking devices which give a visual display of sparks as a deterrent to unruly persons, as well as the capacity to impart a non-fatal, jolting shock should the warning be ignored.

The use of electrical shocking devices is wide-spread, reliable shocking devices being recognized as being a humane technique for handling unruly crowds by many medical personnel and law enforcement officers. Electrical shocking devices for unruly people are useful and accepted by behavior modification laboratories and many law enforcement people for training and controlling people and for personal protection. Shocking devices are commonly used in medical and psychiatric therapy.

Although electrical shocking devices have been in use for many years, they have not achieved optimum satisfaction.

It is known, for example, from the U.S. Pat. No. 2,981,465 to provide an electrical prod with a pair of probes, adapted to contact the skin, voltage to the probes being supplied from a transformer, which has its primary winding connected to a battery via make-and-break contacts. An electromagnetic relay is provided for effecting movement of the contacts. Such an arrangement has a number of drawbacks. The electromagnetic relay requires a core of considerable size and weight, as well as an energizing current source of substantial volume. The contacts, too, tend to pit, wear out, become easily fouled with dirt and dust, and must be regularly adjusted. Such devices are easily damaged by shock and moisture and usually have short battery life.

Other electrical prods are known which include a pair of probes for imparting electric shocks, voltages to the probes being supplied via a transformer which has its primary winding connected to a blocking oscillator. Such prods are described in U.S. Pat. No. 3,819,108. These known prods have the disadvantage of requiring a relatively large transformer, suffer from low output current which produces shock levels insufficient for control. These devices require a direct current source of considerable volume and are usually large and clumsy to handle and store.

SUMMARY OF THE INVENTION

It is an object of the present invention to provide a reliable shocking device which does not require any make-and-break contacts, except the switch.

It is another object of the present invention to provide a shocking device which is both compact and light.

It is a further object of the present invention to provide a shocking device which uses a transformer of extremely small size.

It is an additional object of the present invention to provide a shocking device which is free of any electromagnetic relay.

It is yet another object of the present invention to provide a shocking device which can operate effectively for long periods of time on two 1.5-volt size AA batteries, larger C and D batteries being unnecessary.

It is still a further object of the present invention to provide a shocking device which is sufficiently slim to be easily used in close quarters and the like.

It is yet a further object to provide a shocking device which has its main electrical circuit components housed within a closed tube and therefore free from the effects of moisture, dust, dirt and other contaminants.

It is a principal object of the present invention to provide an improved riot control device which is capable of delivering a jolting shock and which also produces a visible and audible spark discharge.

Other and further objects of the invention will be apparent to those skilled in the art from reading the following description in conjunction with the drawings in which:

FIG. 1 is a schematic diagram of the electrical circuit;

FIG. 4 is an enlarged detail view taken generally along lines 4—4 of FIG. 3.

Figure 2:
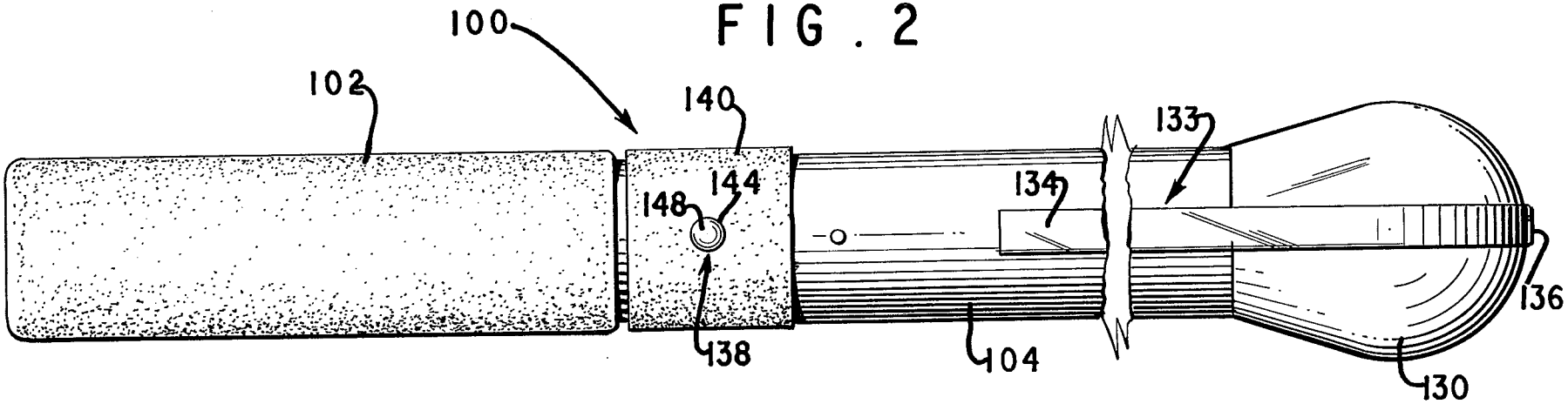
FIG. 2 is a top view of a shocking device utilizing the features of the invention.

The foregoing objects are achieved, in accordance with present invention, by providing an electrical shocking device having two external plates separated by an insulator and charged to a voltage in excess of the air breakdown voltage and which includes a housing means within which there is a direct voltage source, preferably two 1.5-volt power cells, a switch means and a circuit for producing a high, direct voltage from the direct low voltage source. The circuit feeds the produced high voltage intermittently to spaced apart conductive plates which are adapted to be placed against the skin of a person. The person is subjected to a series of high voltage, low current electrical shocks so long as the probes contact the person and the switch for activating the electrical circuit is closed. The housing means is metal, preferably aluminum, and forms one plate. One or more other plates are insulatingly adhered to the housing means. Preferably, a metalized plastic tape is used as the second plate.

The circuit includes a free-running multi-vibrator, a step-up transformer, a rectifier and a spark gap. A voltage multiplier can be associated with the rectifier. Fixed length or telescoping extension handles may be attached to the shocking device for applying the shock from some distance.

As shown in the schematic diagram of FIG. 1, the power cell 20 is connected by the switch 30 across the emitter and the collector electrodes of a pair of transistors 31 and 32. The emitters are connected directly to one terminal of the power source 20. The collectors of the respective power transistors are connected to opposite ends of a center tapped primary winding 33 of a step-up transformer 34, which has its center tap 35 connected to the other terminal of the power source 20.

The base electrode of the power transistor 32 is connected to the collector of the power transistor 31 via a series-connected resistor 37. The base electrode of the power transistor 31 is connected to the collector electrode of the power transistor 32 via a series-connected resistor 36. The two transistors 31 and 32 thus connected constitute a free-running multi-vibrator, which is activated by closing the switch 30.

The step-up transformer 34 has a secondary winding 38 having two end terminals, one of these end terminals being connected to the plate 27 via a series-connected capacitor 39. The other end terminal of the secondary winding 38 is connected to the plate 26 via a series circuit constituted by a rectifying diode 40 and a spark gap 41, the cathode of the diode 40 being connected to one terminal of the spark gap 41. As illustrated, a second diode 42 is connected between the anode of the diode 40 and that terminal of the capacitor 39 which is connected to the plate 27, the cathode of the diode 42 being connected to the anode of the diode 40. A charge capacitor 43 is connected between the cathode of the diode 40 and the anode of the diode 42. A bleeder resistor 44 is connected in parallel with the charge capacitor 43 to assure that a high voltage charge is not stored in capacitor 43 for any appreciable time after use.

The capacitor 39 and the diode 42 constitute a voltage multiplier stage which, with the rectifier diode 40 and the charge capacitor 43, produces a direct voltage output to the plates 26 and 27 of about 1.414 greater than would be produced were the capacitor 39 and the diode 42 not used. It is to be appreciated that in some embodiments the capacitor 39 and the diode 42 need not be used and, in still others, additional stages of voltage multipliers may be used.

In an operative embodiment of the present invention, the power source 20 is made up of two 1.5-volt alkaline power cells, size AA. Each of the diodes 40 and 42 is an IN 4007 semi-conductive device, rated at one ampere, and each of the power transistors 31 and 32 is a transistor manufactured under the number MJE520 by Motorola. The bleeder resistor 44 is a 2.2 megohm resistor, while each of the resistors 36 and 37 is a 22 ohm, one-quarter watt resistor. The capacitors 39 and 43 are each a 0.033 uf, 1000-volt capacitor. The transformer 34 has a small, lightweight ferrite core having three legs, the primary and secondary windings being wound on the center leg.

A practical embodiment of the electrical shocking device without an extension may be about 10 inches long and about seven-eights of an inch in diameter. The weight may be about 4.5 ounces. The device may be readily carried in a belt holster.

Figure 3:
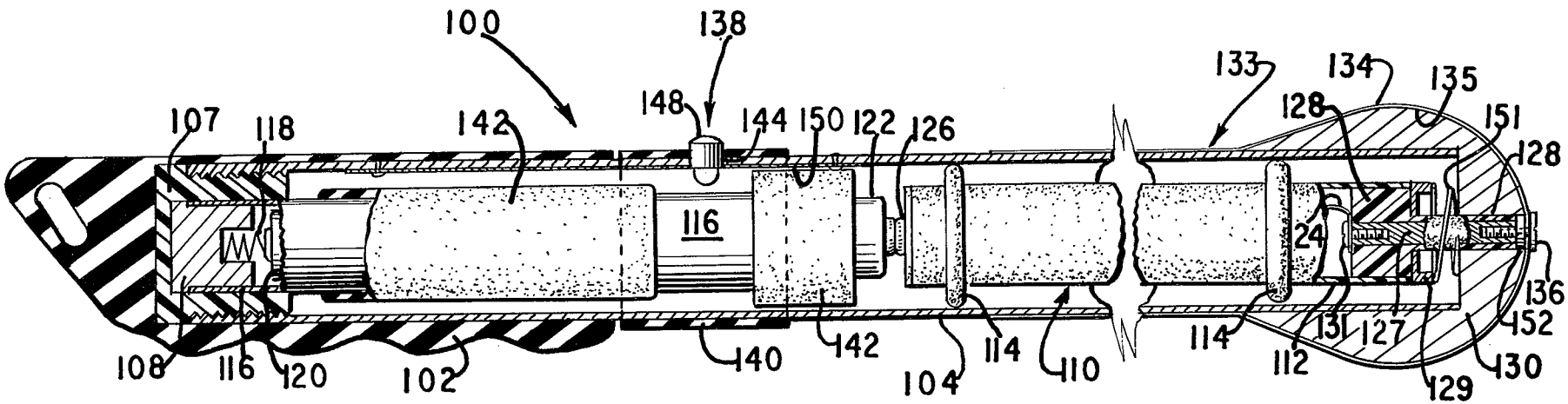
FIG. 3 is a side view partly cut away and partly in section of the shocking device.

The present disclosure is directed to an embodiment having additional desirable features, particularly for riot control. In FIG. 3 the shocking device 100 is provided with an insulating hand grip 102, which may be made of rubber or other electrically nonconductive material, which is connected to a conductive tubular casing member 104, by press fitting. The preferably aluminum casing member 104 is the length of an espantoonor policeman's nightstick and is preferably made of metal. A conductive plug 108 press fits into a threaded insulated bushing 107 and a battery tube 116 press fits onto plug 108 which when assembled, threads into matching threads on the interior of casing member 104.

Disposed within the casing member 104 is a power head assembly 110 contained within a plastic tube 112 which contains the circuit elements described above. Cushion spacers 114 position the assembly 110 in the center of the casing member 104. Also disposed within the casing member 104 is a conductive battery tube 116 preferably made of aluminum which is provided with an insulated sleeve 142 to position it within the casing member 104, and to separate it from the conductive casing member 104. A spring 118 is in contact with the conductive battery tube plug 108 and the base of the batteries 120, 122 and urges the batteries into contact with the power head assembly 110.

Contained within the plastic tube 112 and forming part of the power head assembly are the elements forming the electrical circuit 125, shown within the dashed box of FIG. 1. Contact 126 is engaged by the positive terminal of battery 122. At the opposite end the plastic tube 112 is closed by a nylon bushing 128 which surrounds and supports an internally threaded conductive connector 127. Conductor 24 of the circuit 125 is connected to the one end of connector 127. Conductor 25 of the circuit 125 is connected to a conductive ring or rim contact 129 and spring 151 which completes the circuit to the casing member 104 which corresponds to the plate 27 of FIG. 1.

An aluminum ball 130 is fixedly connected over the end of the casing member 104 and part of the bushing 128 on power head which surrounds and supports the insulated bushing 128 and threaded connector 127. Strands of metalized tape 133 having a conductive metal surface 134 with an adhesive insulator backing 135 are adhered to the aluminum ball 130 and the tubular casing member 104 in a prearranged pattern as may be seen in FIG. 4. The metalized surface of the strands is connected by a tape contact screw 136 thru an insulated washer 152 to connector 127 and by high voltage contact screw 131 to conductor 24.

A switch means 138 is made up of a non-conductive ring 140 surrounding the casing member 104 at a location convenient to the hand grip 102 so that the switch may be operated by the thumb of the holder. The ring 140 is pressed over the casing member 104. An insulated cap 148 passes through an opening 144 in the casing member 104 and is attached to flat spring 150 which is attached to casing member 104 by rivets or other means. The insulating cap 148 is fixedly connected to the flat spring 150 and is resiliently urged outwardly by the spring 150 and insulated battery tube sleeve 142.

When the switch means 138 is pressed, contact is made with the battery tube thru battery tube sleeving opening directly beneath the switch spring 150 and the battery circuit is completed.

The metalized tape with an adhesive insulator backing provides a spark gap means that has a firing voltage depending on the thickness of the insulator material. When the circuit is energized, high voltage causes sparking from the metalized portion of the tape to the aluminum housing. When the electrode spark gap has a sufficiently high firing voltage, a shock can be received as the body resistance is lower than the free air resistance. The frequency voltage and current output may be varied by changes in the power supply voltage, transformer design, capacitor values, spark gap firing voltage and transistor characteristics.

Other and further embodiments of the present invention may be made. For instance, the circuitry and power source may be disposed inside of an insulating band adapted to fit around the fingers of one hand with the external plates mounted on the outer surface away from the hand. This form of electronic "brass knuckles" enables a weak person to protect herself from an attacker at close quarters with no danger of injury to innocent bystanders.

What is claimed is:

1. A hand-held electrical shocking device which in the energized operative condition produces a visible and audible external spark and delivers a jolting electrical shock when contacting the skin, comprising in combination:

a. A conductive, hollow, tubular housing having an insulating hand grip at one end and forming a first plate;

b. At least one second plate connected to the surface of said housing by an electrically insulating material in spaced apart relation to said housing;

c. A low direct voltage power source positioned within said housing and adapted to be electrically connected to said housing by a switch;

d. A hollow, tubular member positioned within said housing and containing an electronic circuit means coupled to said power source and said housing, said electronic circuit means being adapted to provide a series of short duration, high voltage, low current electrical impulses to said first and second plates.

2. A riot control device comprising in combination:

a. A tubular housing made of an electrically conductive material and having at one end a hand grip made of an electrically insulating material, the outer surface of said housing comprising the first plate of an electrical spark gap;

b. At least one strip of electrically conductive material held in fixed, spaced apart relation to said housing by an electrically insulating material, said electrical conducting material constituting the second plate of a spark gap;

c. An electronic circuit means disposed within said tubular housing and operatively connected to said first and second plates, and being adapted to deliver a series of short duration, high voltage, low current electrical pulses to said first and second plates;

d. A power source positioned within said housing and operatively connected to said electronic circuit means and being adapted to be selectively connected or disconnected to said first plate;

whereby when said power source is connected to said plate the circuit is completed and visible and audible sparks pass between said first and second plates.

3. A manipulatable electrical shocking device comprising in combination:

a. A housing;

b. At least one strand of metalized tape disposed in a predetermined pattern on the exterior of said housing;

c. A hollow tubular member positioned within said housing;

d. A low direct voltage power source positioned within said housing;

e. An electronic circuit means disposed within said hollow tubular member and adapted to be operatively coupled to said power source and said metal surface of said metalized tape and further comprising:

1. Oscillator means positioned within said tubular member for producing an alternating current output;

2. A step-up transformer positioned within said tubular member having its primary winding coupled to receive the alternating current output from said oscillator means for producing a high alternating voltage across its secondary winding;

3. Rectifying means positioned within said tubular member for producing a high direct voltage output, said rectifying means including a rectifier and charge storage means coupled to said secondary winding for producing a direct voltage across said charge storage means, one end of said charge storage means being coupled to said housing;

4. Spark gap means positioned within said tubular member for producing repeated pulses of high voltage current, said spark gap means being connected in series between said charge storage means and the metal side of said metalized tape, whereby when the circuit is energized, high voltage causes sparking from the metalized portion of said tape to the aluminum housing and when said charge storage means has a sufficiently high firing voltage, delivers a series of short duration, high voltage, low current electrical shocks to objects in contact with both said housing and said metal side of said metalized tape.

* * * * *